United States Patent [19]

Harkus

[11] Patent Number: 4,971,247

[45] Date of Patent: Nov. 20, 1990

[54] PAD FOR PLACING UNDER A RAILWAY RAIL AND A RAIL-AND-FASTENING ASSEMBLY INCLUDING THE PAD

[75] Inventor: Lance Harkus, New South Wales, Australia

[73] Assignee: Pandrol Limited, London, United Kingdom

[21] Appl. No.: 260,174

[22] Filed: Oct. 19, 1988

[30] Foreign Application Priority Data

Oct. 19, 1987 [AU] Australia ..... 79914/87

[51] Int. Cl.[5] ..... E01B 9/40

[52] U.S. Cl. ..... 238/283; 238/349; 238/306

[58] Field of Search ..... 238/264, 287, 107, 265, 238/292, 306, 283, 382, 285, 304, 349, 351, 266, 275, 278; 267/292, 140, 153

[56] References Cited

U.S. PATENT DOCUMENTS

| | | | |
|---|---|---|---|
| 853,684 | 5/1907 | De Remer | 238/306 |
| 1,822,963 | 9/1931 | Ennis et al. | 238/304 X |
| 2,713,974 | 7/1955 | Lofton | 238/283 |
| 3,295,760 | 1/1967 | Moses | 238/283 |
| 3,904,112 | 9/1975 | Thim et al. | 238/265 X |
| 3,920,183 | 11/1975 | Houghton | 238/287 X |
| 4,175,700 | 11/1979 | Gehrke | 238/304 X |
| 4,254,908 | 3/1981 | Matsubara | 238/283 |
| 4,316,578 | 2/1982 | Reynolds et al. | 238/264 X |
| 4,447,006 | 5/1984 | Matsuo | 238/351 |
| 4,454,985 | 6/1984 | Carter | 238/283 X |
| 4,618,093 | 10/1986 | Young et al. | 238/304 X |
| 4,632,308 | 12/1986 | Fischer | 238/265 |
| 4,696,429 | 9/1987 | Ortwein | 238/382 X |
| 4,715,533 | 12/1987 | Bucksbee et al. | 238/264 X |
| 4,757,945 | 7/1988 | Leeves | 238/107 |

FOREIGN PATENT DOCUMENTS

| | | | |
|---|---|---|---|
| 0232029 | 8/1987 | European Pat. Off. . | |
| 1204262 | 8/1959 | France . | |
| 1481961 | 4/1967 | France . | |
| 0797889 | 7/1958 | United Kingdom | 238/283 |
| 841776 | 7/1960 | United Kingdom . | |
| 2077330 | 12/1981 | United Kingdom . | |

*Primary Examiner*—Robert P. Olszewski
*Assistant Examiner*—Mark T. Le
*Attorney, Agent, or Firm*—Norbert P. Holler

[57] ABSTRACT

A pad has a base portion, which lies on a foundation and on which a flange of a railway rail lies, and upstanding side portions extending upwardly from opposite sides of the base portion and formed with a recess in which lies a part of a rail clip. The pad may have sideways-extending portions for projecting on opposite sides of a clip-retaining member and it may also have projecting islands, possibly chevron-shaped, on one face or on both faces. The base portion may be one member made of soft material and this may be fixed to a separate member made of harder material which is formed with the side portions and the recess.

15 Claims, 9 Drawing Sheets

PAD FOR PLACING UNDER A RAILWAY RAIL AND A RAIL-AND-FASTENING ASSEMBLY INCLUDING THE PAD

FIELD OF THE INVENTION

This invention relates to a pad which is to lie under a railway rail.

PRIOR ART

It is known from European Pat. Specification No. 0232029 and its U.S. equivalent, U.S. Pat. No. 4,757,945, to provide a pad which is suitable to space the bottom of a railway rail from a rail foundation on which the rail stands, the pad having a base portion of soft material which is to lie underneath the bottom of the rail and upstanding side portions of harder material extending upwardly from opposite sides of the base portion. In that specification it is disclosed that the rail is held down by a clip which has been made by bending a steel rod and which, as seen in plan view, looks rather like a letter e, the centre arm only of the e being driven, in a direction parallel to the length of the rail, into a passageway through a clip-retaining member, the upper arm of the e bearing downwardly on a surface which, as seen from the rail, is beyond the passageway and the lower arm of the e bearing downwardly on a flange at the base of the rail. The upper arm and the lower arm of the e are connected by a part of the clip which in plan view looks like a reverse bend (a 180° bend) and in end view (looking along the length of the rail) looks like an arch, so that the clip is far from flat and it does not touch the pad.

OBJECT OF THE INVENTION

It is an object of the present invention to construct a pad which is suitable for the case where the clip is substantially of the shape of a letter e and it is flat, that is to say the axis of the whole of the rod, from which the clip was made, lies in a single plane and both the centre arm and the upper arm of the clip are driven into a passageway, of elongate cross-section, through the clip-retaining member.

OUTLINE OF THE INVENTION

According to a first aspect of the present invention, there is provided a pad which is suitable to space the bottom of a railway rail from a rail foundation on which the rail stands, the pad comprising a base portion which is to lie underneath the bottom of the rail, upstanding side portions extending upwardly from opposite sides of the base portion and portions of at least one of the side portions defining at least one recess therein to receive part of a clip for holding the rail down on the rail foundation, whereby any tendency for the clip to move in at least one direction along the side portion, i.e. along the rail, is countered.

INTRODUCTION TO THE DRAWINGS

Examples in accordance with the invention are described below with reference to the accompanying drawings, in which:

FIG. 1 shows an end view of part of a railway rail-and-fastening assembly including a rail standing on a pad, FIG. 2 shows a plan view of the part shown in FIG. 1, with part of the rail removed to show what lies beneath it, FIG. 3 shows a top plan view of one corner of the pad, FIG. 4 shows an underneath plan view of the same corner of the pad, FIG. 5 shows a sectional view of part of the pad, taken as indicated by the arrows V in FIG. 4, FIG. 6 shows a view of a portion of the pad, taken as indicated by the arrow VI in FIG. 3, FIG. 7 shows a plan view of a second pad, FIG. 8 shows an end view of the second pad, FIG. 9 shows a sectional view of the second pad, taken as indicated by the arrows IX in FIG. 7, FIG. 10 shows an underneath plan view of a first component of a third pad, FIG. 11 shows a top plan view of part of the first component, FIG. 12 shows a sectional view, taken as indicated by the arrows XII in FIG. 11, of the same part of the first component, FIG. 13 shows a central web of the pad, in a view corresponding to FIG. 12, FIG. 14 shows a sectional view of the central web, taken as indicated by the arrows XIV in FIG. 10, FIG. 15 shows an end view of one side of the first component, FIG. 16 shows a top plan view of a second component of the third pad, FIG. 17 shows an underneath plan view of one corner of the second component, FIG. 18 shows a sectional view of the second component, taken as indicated by the arrows XVIII in FIG. 17, and FIG. 19 shows an end view of the second component.

DETAILED DESCRIPTION OF PARTS SHOWN IN THE DRAWINGS

Figure 1:
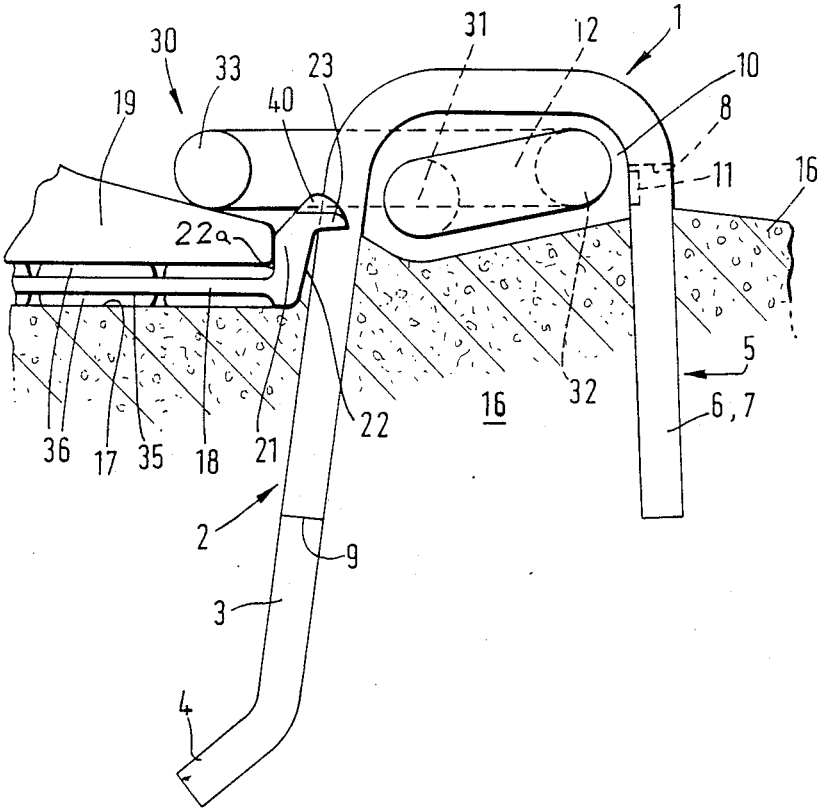
Figure 2:
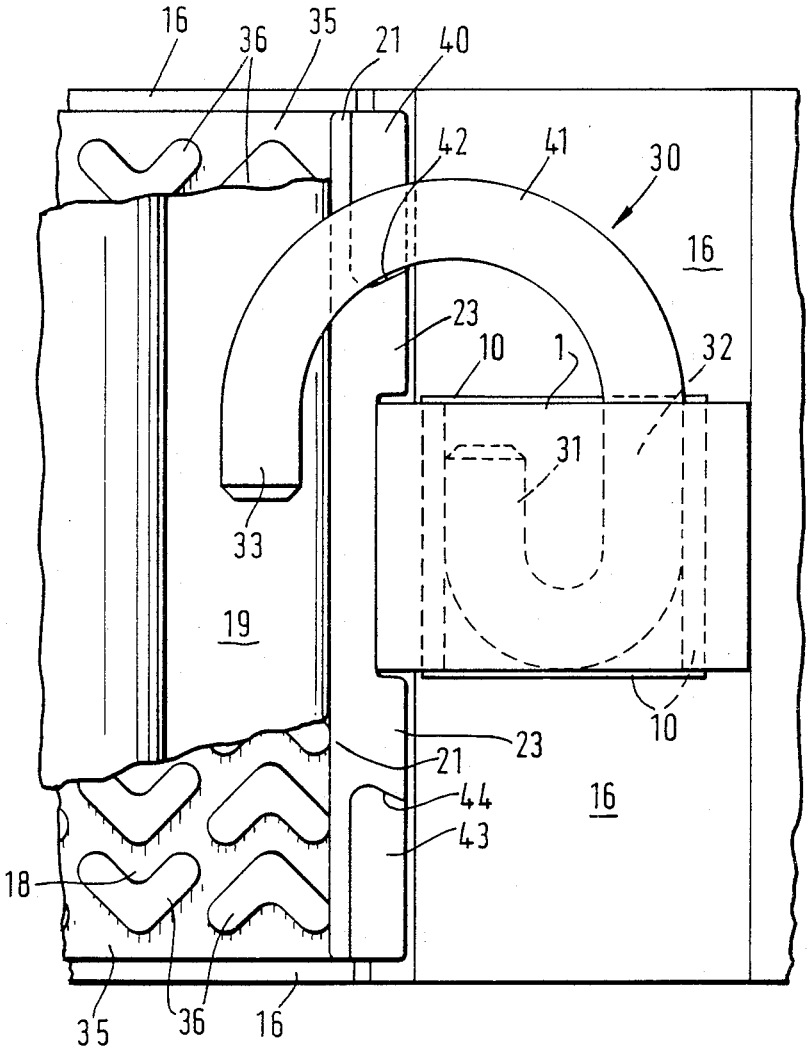
Figure 3:
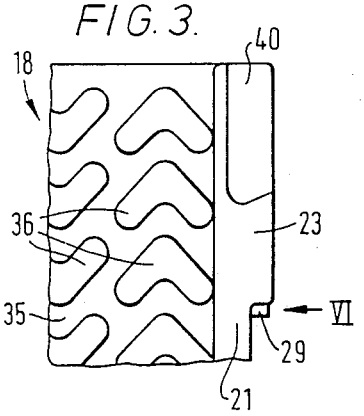
Figure 4:
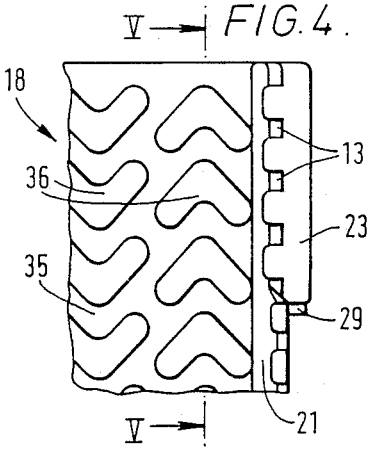
Figure 5:
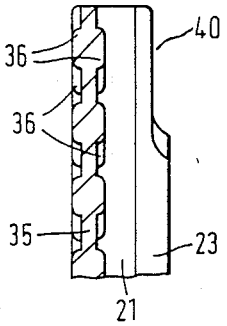
Figure 6:
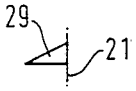

FIGS. 1 and 2 show a clip-retaining member 1, made by bending a strip of sheet steel, in the form of an arch having a left side 2, the lower parts 3 and 4 of which are narrower than the remainder, and a right side 5 consisting of a front part 6 and a rear part 7 behind it. From the tops 8 of the parts 6 and 7 to the top 9 of the part 3, the member 1 is of uniform width, measured vertically in FIG. 2. A bushing 10 of electrically insulating material fits in the top of the arch and a projection 11 on one side of the bushing extends between the parts 6 and 7 of the member 1. The bushing is formed with a passageway 12, the cross-section of which has a shape like that of a conventional athletics race track, its straight and parallel sides being inclined to the horizontal, whereas the top of the bushing is horizontal, considering FIG. 1. Most of the member 1 is incorporated in a concrete railway sleeper 16 in which is formed a recess 17 in which lies a pad having a base portion 18 on which stands the flange 19 of a railway rail. The term "railway sleeper" is used herein to mean what is often called a "rail tie". The pad has upstanding portions 21 extending from the base portion 18 along two opposite edges of the pad and these upstanding portions 21 have inclined outer faces 22, remote from the rail, which bear against side walls of the recess 17, and substantially vertical inner faces **22*a*, proximate to the rail, which bear against and thus serve to locate the flange of the rail. At the tops of the upstanding portions 21 there are sideways-extending portions 23 which project on opposite sides of the clip-retaining member 1. The entire pad is a single-piece moulding of electrically insulating material and, to save material, it has recesses in the bottoms of the upstanding portions 21, these recesses being separated by portions 13** of the insulating material.

A clip 30, made by bending a rod of steel of circular cross-section into the shape of a letter 3, with the axis of the entire rod lying in a single plane, has the centre arm 31 and the upper arm 32 of the e driven into the passageway 12 through the bushing 10 and the lower arm 33 of the e bearing downwardly on the upper surface of the flange 19 of the rail, with the result that the clip is distorted as shown in FIG. 1.

The base portion 18 of the pad is formed with recesses in both opposite major faces, with the result that it consists of a central web 35 from opposite faces of which project islands 36 which are in the shape of chevrons and are arranged in rows and in columns perpendicular to the rows, with the chevrons on one face of the pad registering with those on the opposite face.

At one end of the pad a recess 40 is formed in the upstanding portion 21 and in the sideways-extending portion 23 of the pad. Structurally, to define the recess 40, the upstanding side portion 21 is so formed that its height, above the base portion 18, has a first magnitude in the region of the center of the length of the side portion 21 and a lower but still substantial second magnitude in a zone between that center region and one end of that side portion. This recess receives part of a reverse bend 41 of the clip, which portion connects together the arms 32 and 33. When the clip is driven horizontally (i.e. downwardly, considering FIG. 2), part of the reverse bend 41 travels along the recess 40, inside it, until it is arrested by the end wall 42 of the recess 40, whereupon the clip can move no further in the same direction. The structure of the recess 40 can thus be also described in another way. Viewing the pad as having first and second extremities (for example, the top and bottom edges, respectively, of the pad as shown in FIG. 2) and third and fourth extremities (for example, the illustrated right and unillustrated left edges of the pad as shown in FIG. 2), with the third and fourth extremities being transverse to the first and second extremities, and with the upstanding side portions 21 extending along and parallel to the third and fourth extremities, the recess 40 is limited at one boundary thereof by the upstanding end wall 42 which, as clearly shown in FIG. 2, is nearer to the first extremity of the pad than it is to the second extremity and which faces in the general direction towards the first extremity. It will be understood, of course, that although in principle it is not necessary, it is preferred to have a similar recess 43 with an end wall 44 which arrests movement of the clip if it is driven in the opposite direction.

One corner of the pad is shown in FIGS. 3 to 6; the pad is similar at the other corners. FIGS. 3 to 6 show a projection 29, of triangular cross-section, on the end of the sideways-extending portion 23 which is adjacent the member 1. This serves to locate the pad in the correct position in relation to the clip-retaining member 1. It is flattened against the edge of the member 1.

Figure 9:
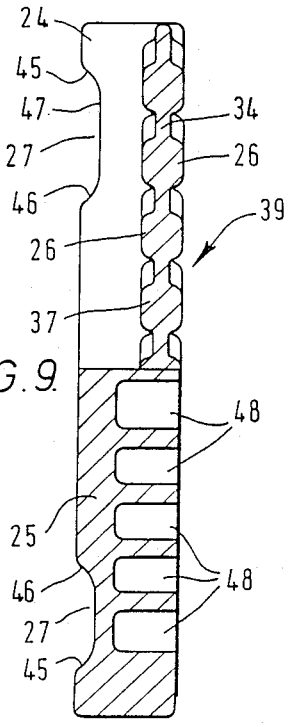
Figure 7:
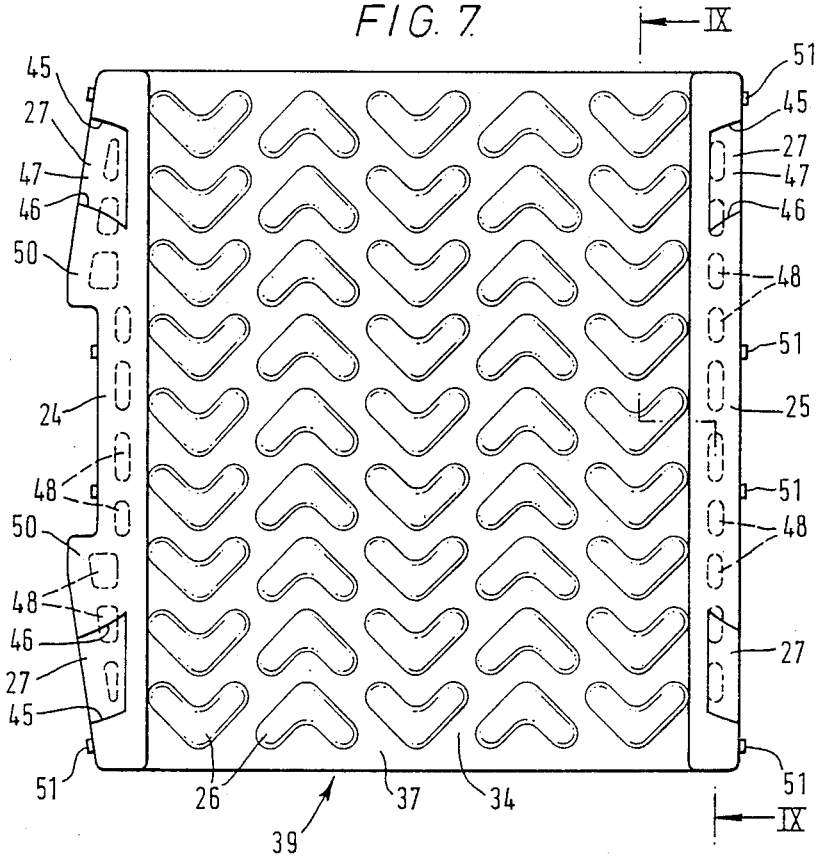
Figure 8:
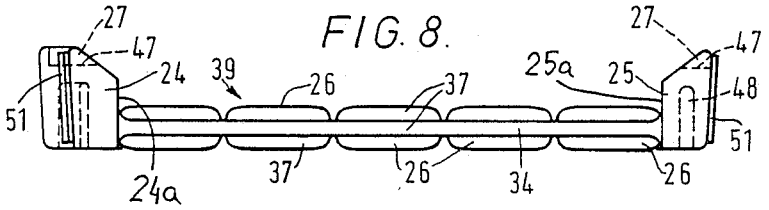

The pad 39 shown in FIGS. 7 to 9 is made by moulding suitable electrically insulating material to form a single piece including a base portion 37 and upstanding side portions 24 and 25 extending upwardly from opposite sides of the base portion 37 and having substantially vertical inner faces **24*a* and 25*a* for locating the rail (not shown). There are on each face of a flat plate-like web 34 of the base portion 37 three rows each of nine chevron-shaped projections 26, the chevrons pointing downwardly, considering FIG. 7, and two rows each of nine chevron-shaped projections 26, the chevrons pointing upwardly, considering FIG. 7. The two different kinds of row alternate, proceeding across the width of the base portion 37. The chevrons on one face register with those on the opposite face. The thickness of the base portion 37 is about 11 mm. and the thickness of the plate-like web 34** of it is about 4 mm.

The top of each of the side portions 24 and 25 is formed with two recesses 27, each of which is bounded on two opposite sides by curved walls 45 and 46 and has a floor 47. Structurally, of course, the side portions 24 and 25 have the same characteristics as the side portions 21 described previously with reference to FIGS. 1 and 2, in that the height of each side portion above the base portion of the pad is of a first magnitude in the center region of the side portion and of a lower but still substantial second magnitude in a zone between that center region and one end of that side portion, and in that at least one of the recesses 27 in each side portion is defined by at least one end wall 46 which is nearer to the first extremity of the pad than it is to the opposite second extremity and which faces generally towards the first extremity of the pad. Recesses 48 are formed in the under sides of the portions 24 and 25 to save material.

The pad 39 is intended to be used in an assembly according to FIGS. 1 and 2, in place of the pad shown in those Figures, with two clips as shown in FIGS. 1 and 2 driven in opposite directions and their reverse bends 41 lying in diagonally opposite recesses 27, whereby any tendency for the clip to move in either direction along the side portion 24 or 25, i.e. along the rail, is countered.

Only one of the side portions 24 and 25, i.e. the side portion 24, is formed on its outer side, i.e. the side remote from the portion 25, with two ears 50 projecting sideways away from the side portion 25. Part of the clip-retaining member 1 is intended to lie between the two ears 50 and the pad 1 is prevented by this from moving along the rail. The two recesses 27 in the side portion 24 extend into the ears 50. There are eight projections 51 on the pad, four on each of the side portions 24 and 25, which serve to locate the pad in the correct position and compensate for any inaccuracies in the dimensions of the pad, the clip-retaining member 1 and the recess 17 in the sleeper.

The base portion 37 could have an overall thickness other than 11 mm., for example 6 mm. Instead of there being two recesses 27 in each of the side portions 24 and 25, there could be only one wider recess, extending all the way from one wall 45 to the other, since it is primarily withdrawal movement of each clip, i.e. movement in a direction opposite to that in which it has been driven into the clip-retaining member 1, that is to be prevented and the walls 46 of the recesses 27 play no part in this. However, if there are the two recesses 27 in each of the side portions 24 and 25, the advantage is obtained that when the part 41 of the clip drops into one of them the operative knows that the clip has been driven far enough and the wall 46 of that recess prevents overdriving of the clip. Also the sloping upper surfaces of the parts of the pad between the two recesses 27 in each side portion 24 or 25 guide the rail into its desired position.

Each of the pads described above and shown in FIGS. 1 to 9 is made throughout from a single hard material, for example high-density polyethylene or nylon. The pads not only electrically insulate the rails from the concrete railway sleepers, which is necessary if the rails are to be used to carry electric currents for signalling purposes, but also reduce the transmission of dynamic forces from passing trains to the sleepers. For the situations where the dynamic forces are very great, for example where the rails are to carry very rapidly moving trains, it would be desirable to make the parts of the pad which lie underneath the rail flange of softer material, for example natural rubber, but then the upstanding portions 21 or 24 and 25 along two opposite edges of the pad, if they were of the same material, would not be sufficiently strong. Accordingly, it is proposed to use in such circumstances a pad as described below consisting of a soft rubber part to lie under the rail flange, and having no upstanding portions along two opposite edges, and a harder part, for example made of high-density polyethylene or nylon, having those upstanding portions.

Figure 14:
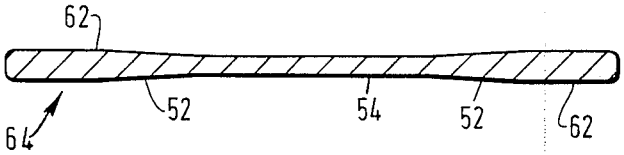
Figure 12:
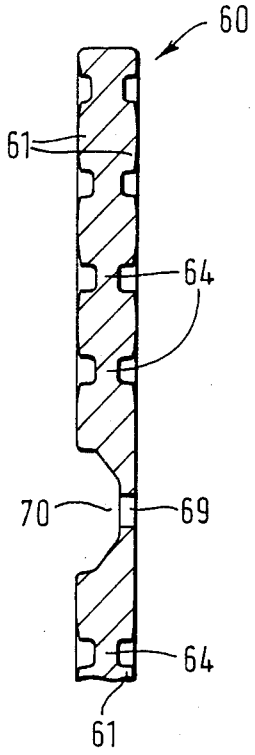
Figure 13:
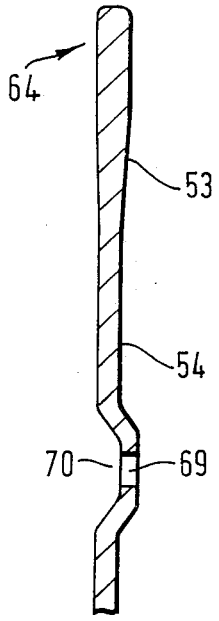
Figure 15:
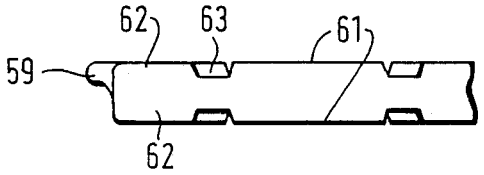

FIGS. 10 to 15 show a soft rubber part 60 having recesses in its two opposite major faces. The recesses extend to the two edges of the pad shown as horizontal in FIG. 10 but not to the other opposite edges shown as vertical in FIG. 10. The recesses form on each of the major faces of the pad islands 61 of chevron shape and, along the two edges which are shown as vertical in FIG. 10, strips 62 having tongues 63 extending from them, these islands, strips and tongues projecting from opposite faces of a central web 64, with which they are integral. The islands, strips and tongues on one face of the pad register with those on the opposite face. FIGS. 13 and 14 show the web 64 without the islands, strips and tongues, in order to show that in regions 52 and 53 the thickness of the web progressively increases, proceeding from a central area 54 of the pad, in both directions along a first line 65 extending centrally across the pad (this increase in thickness is shown in FIG. 14) and in both directions along a second line 66 extending across the pad (this increase in thickness is shown in FIG. 13).

In a central band 68 of the pad, through which there is a circular hole 69 at the centre of the pad, there are no recesses in the lower face of the pad but there is a deep recess 70 in the upper face of the pad.

Figure 10:
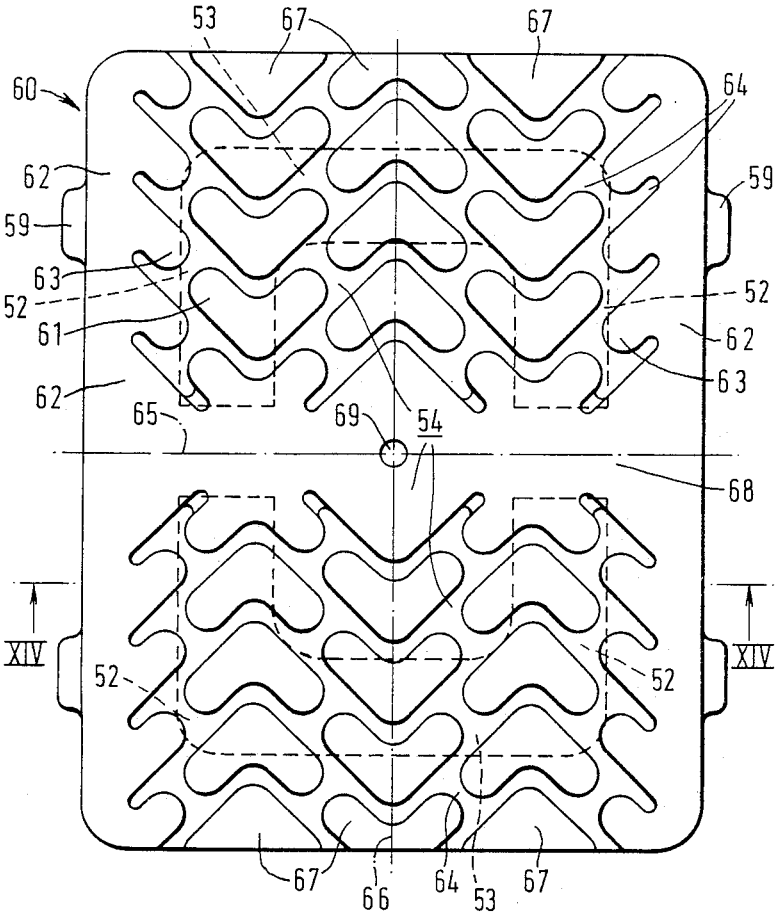
Figure 11:
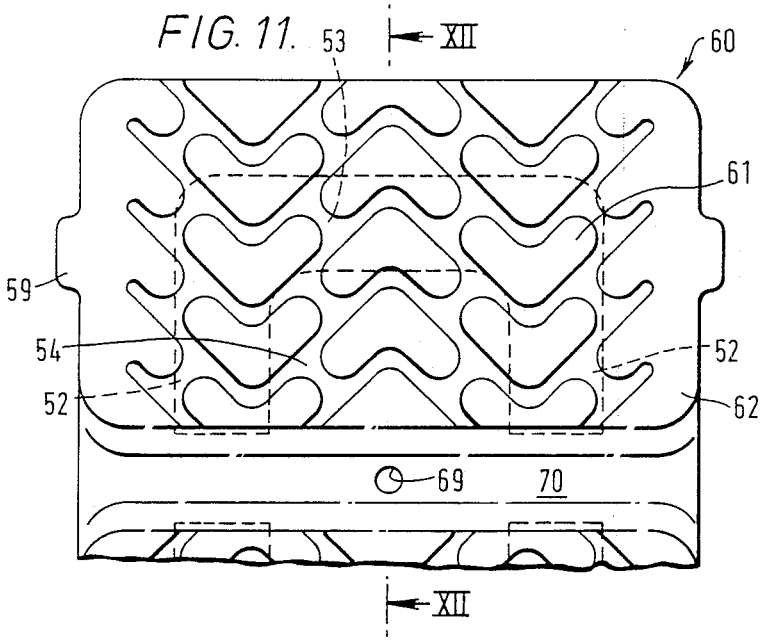

The chevrons 61 are arranged in rows which are horizontal in FIG. 10 and in columns which are perpendicular to the rows. Proceeding along any row, there is firstly a chevron pointing in one direction, then a chevron pointing in the opposite direction and finally a chevron pointing in the first direction. Proceeding along any column, there are firstly three chevrons pointing in one direction and then three chevrons pointing in the opposite direction. At the ends of the columns there are projections 67 corresponding in shape to parts of chevrons.

There are four lugs 59 extending from the longer sides of the pad.

Figure 16:
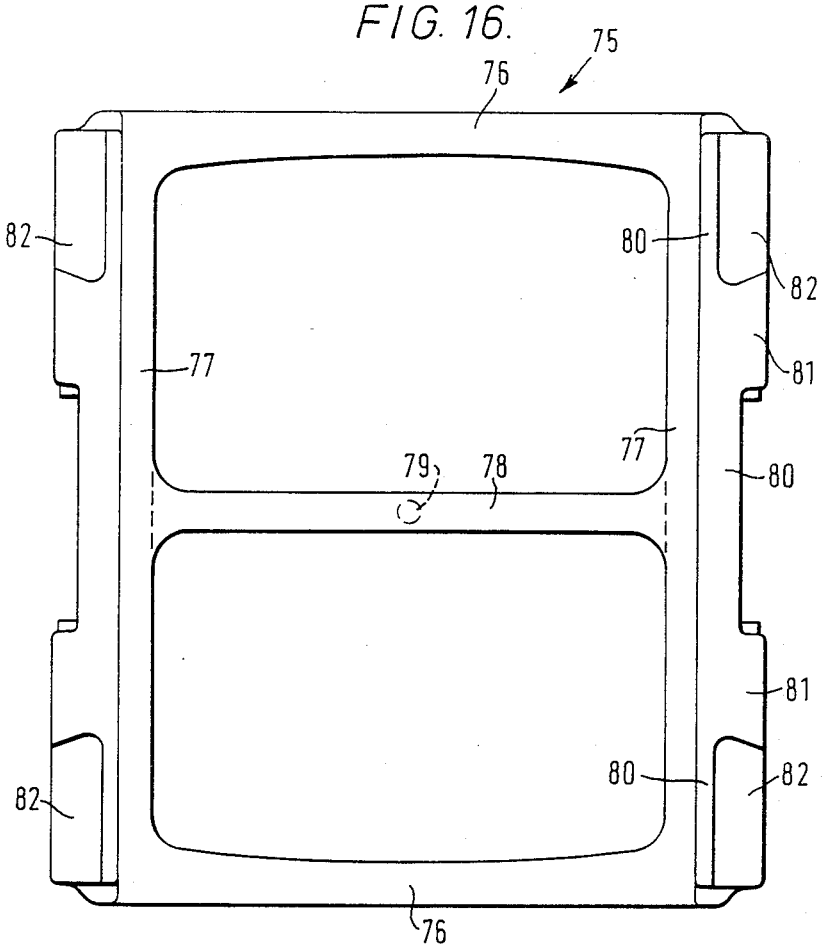

The harder part 75 of the pad includes two parallel end limbs 76, which are spaced apart by a distance (measured vertically in FIG. 16) which is a little greater than the length (measured vertically in FIG. 10) of the soft part 60 of the pad, and two parallel side limbs 77, which are spaced apart by a distance (measured horizontally in FIG. 16) which is a little greater than the width (measured horizontally in FIG. 10) of the soft part 60 of the pad. The two side limbs 77 are connected together by a cross arm 78 from the centre of which there projects a stud 79. The soft part 60 of the pad lies partly within a frame formed by the limbs 76 and 77 of the hard part 75 and the cross limb 78 lies in the recess 70 in the soft part, with the stud 79 projecting into the hole 69. The lugs 59 lie above the side limbs 77.

The upper surface of the soft part 60 of the pad and the upper surface of the web 64 are higher than the tops of the limbs 76 to 78 of the hard part 75 of the pad.

Figure 17:
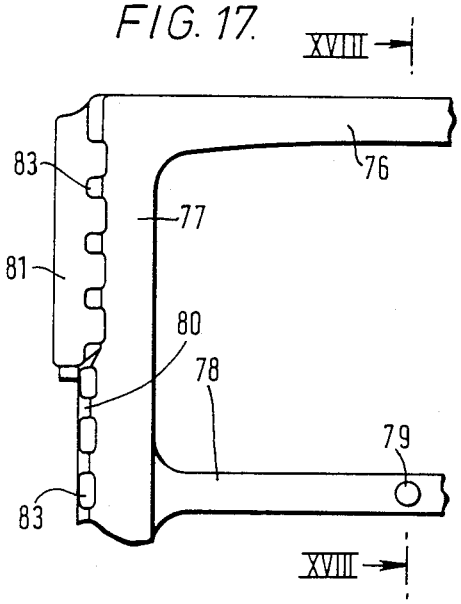
Figure 18:
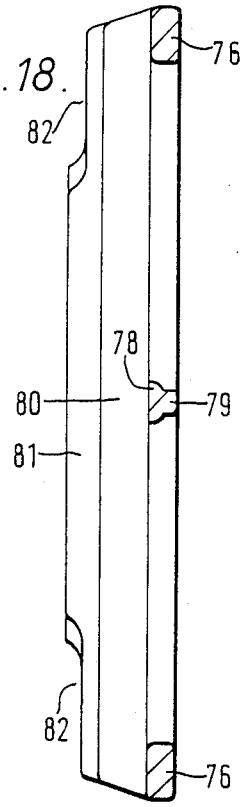
Figure 19:
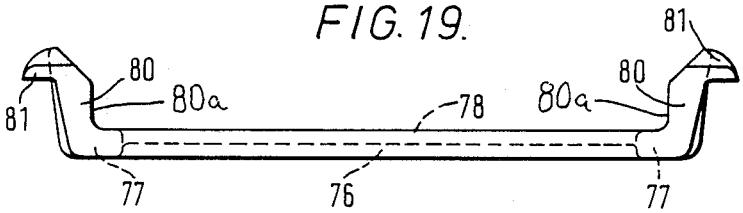

Two upstanding portions 80 with substantially vertical inner faces **80*a* (FIG. 19) for locating the rail extend from opposite edges of the hard part 75 of the pad and sideways-extending projections 81 extend from the tops of the portions 80. Recesses 82 are formed in the parts 80 and 81 and these side portions and recesses have the same structural and functional characteristics as the side portion 21 and the recess 40 described in relation to FIGS. 1 to 6. Recesses, separated by portions 83 of the hard part 75, see FIG. 17**, are provided to economise in material.

The islands 61, strips 62 and tongues 63 on one face of the pad shown in FIGS. 10 to 15, and corresponding parts in the other illustrated pads, could be omitted if desired.

I claim:

1. A pad which is suitable to space the bottom of a railway rail from a rail foundation on which the rail stands, the pad having two opposite upper and lower major faces and comprising a base portion, part of which is to lie underneath the bottom of the rail, the base portion having first and second elongate and parallel opposite edge regions at respective opposite extremities of the base portion, and the pad further comprising first and second elongate upstanding side portions each having an innermost flank and an outermost flank, said side portions being formed integrally with said first and second edge regions, respectively, of the base portion and extending upwardly from them and along and parallel to them, the innermost flanks, facing one another, of the first and second upstanding side portions having parts which are substantially vertical when the base portion is horizontal, whereby said parts may locate the rail, and the height, above the base portion, of at least one of the side portions having a first magnitude in the region of the center of the length of the side portion and a lower but still substantial second magnitude in a zone between said center region and one end of that side portion whereby there is formed in that side portion a recess to receive part of a clip for holding the rail down on the rail foundation, whereby any tendency for the clip to move in at least one direction along the respective side portion is countered.

2. A pad according to claim 1 in which the base portion comprises chevron-shaped projections on at least one of its major faces.

3. A pad according to claim 2 in which the chevron-shaped projections are in several rows which extend parallel to the lengths of the side portions, rows in which the chevron-shaped projections point in one direction parallel to the lengths of the side portions alternating, across the width of the base portion, with rows in which the projections point in the opposite direction.

4. A pad according to claim 1 in which one only of said side portions is formed on its outer side with two ears projecting sideways away from the other side portion, whereby part of a retaining member for retaining a rail-fastening clip may lie between the two ears and the pad is prevented by this from moving in a direction parallel to the lengths of the side portions.

5. A pad according to claim 1 in which said recess in said at least one side portion is located adjacent to one end of that side portion and comprises an end wall at only that end boundary of the recess which is remote from said one end of the side portion, which end wall limits movement of the clip.

6. A pad according to claim 1 comprising portions defining recesses in its two opposite major faces whereby there are formed in each of these faces several islands of the pad material which are joined together by a central web of the pad material, the thickness of the web progressively increasing, proceeding from a central area of the pad in both directions along a first line across the pad and along a second line across the pad, perpendicular to the first line.

7. A pad according to claim 6 in which said islands are chevron-shaped and the chevrons are in rows and in columns perpendicular to the rows, all the chevrons in one half of one column pointing in the same direction and all the chevrons in the other half of the same column pointing in the opposite direction, the chevrons pointing in opposite directions alternately, proceeding along the rows.

8. A pad according to claim 1 comprising a soft part, which is to lie under the bottom of the rail and has no upstanding portions on it, and a harder part into which the soft part fits and which has the upstanding portions with the recesses formed in them for reception of part of the clip.

9. A pad according to claim 8 in which the hard part comprises a frame, within which part of the soft part lies, and a limb extending across the frame, the soft part comprising portions defining a recess extending across the soft part, in which recess said limb lies.

10. A pad according to claim 9 comprising a stud on one of said parts of the pad and portions of the other such part defining a hole to receive the stud to secure the soft part to the hard part of the pad and lugs on the soft part, said hard part comprising side arms above which said lugs lie.

11. A pad which is suitable to space the bottom of a railway rail from a rail foundation on which the rails stands, the pad comprising a base portion which has two opposite major faces and is to lie underneath the bottom of the rail, upstanding side portions extending upwardly from opposite sides of the base portion and portions of at least one of the side portions defining at least one recess therein to receive part of a clip for holding the rail down on the rail foundation, whereby any tendency for the clip to move in at least one direction along the side portion is countered, the pad comprising portions defining recesses in its two opposite major faces whereby there are formed in each of these faces several islands of the pad material which are joined together by a central web of the pad material, the thickness of the web progressively increasing, proceeding from a central area of the pad in both directions along a first line across the pad and along a second line across the pad, perpendicular to the first line.

12. A pad which is suitable to space the bottom of a railway rail from a rail foundation on which the rail stands, the pad comprising a base portion which has two opposite major faces and is to lie underneath the bottom of the rail, upstanding side portions extending upwardly from opposite sides of the base portion and portions defining at least one recess therein to receive part of a clip for holding the rail down on the rail foundation, whereby any tendency for the clip to move in at least one direction along the side portion is countered, the pad comprising a hard part which is a frame which has said upstanding portions on it and a limb extending across it, the pad further comprising a soft part which lies within the frame and fits it, the soft part being for lying under the bottom of the rail, having no upstanding portions on it and comprising portions defining a recess extending across the soft part, in which recess said limb lies.

13. A pad which is suitable to space the bottom of a railway rail from a rail foundation on which the rail stands, the pad having two opposite major faces and comprising a base portion part of which is to lie underneath the bottom of the rail, upstanding side portions extending upwardly from opposite sides of the base portion and portions of at least one of the side portions defining at least one recess therein to receive part of a clip for holding the rail down on the rail foundation, whereby any tendency for the clip to move in at least one direction along the side portion is countered, the pad further comprising portions defining recesses in its two opposite major faces, whereby there are formed in each of these faces several islands of the pad material which are joined together by a central web of the pad material, the thickness of the web progressively increasing, proceeding from a central area of the pad in both directions along a line across the pad.

14. A pad which is suitable to space the bottom of a railway rail from a rail foundation on which the rail stands, the pad having two opposite upper and lower major faces, first and second opposite extremities and third and fourth opposite extremities transverse to said first and second extremities, the pad further having a base portion part of which is to lie underneath the bottom of the rail, and first and second elongate upstanding side portions each having an innermost flank and, respectively, extending along and parallel to said third and fourth extremities of the pad and projecting upwardly from said third and fourth extremities of the pad; wherein the improvement comprises:

at least one of said side portions is provided in the top thereof with a recess, said recess being limited at one end boundary thereof by an upstanding wall which is nearer to said first extremity of the pad than it is to said second extremity of the pad and which faces in the general direction towards said first extremity of the pad, and said recess being suitable to receive part of a clip for holding the rail down on the rail foundation, whereby any tendency for the clip to move in at least one direction along said at least one side portion is countered, and parts of the innermost flanks, facing one another, of the two side portions are substantially vertical when the base portion is horizontal, so that said side portions may accurately locate the bottom of a railway rail when the bottom of the rail is placed between said side portions.

15. A pad which is suitable to space the bottom of a railway rail from a rail foundation on which the rail stands, the pad having two opposite upper and lower major faces, first and second opposite extremities and third and fourth opposite extremities transverse to said first and second extremities, the pad further having a base portion part of which is to lie underneath the bottom of the rail, and first and second elongate upstanding side portions extending along and parallel to said third and fourth extremities of the pad and projecting upwardly from said third and fourth extremities of the pad; wherein the improvement comprises:

at least one of said side portions is provided in the top thereof with a recess, said recess being limited to one end boundary thereof by an upstanding wall which is nearer to said first extremity of the pad than it is to said second extremity of the pad and which faces in the general direction towards said first extremity of the pad, and said recess being suitable to receive part of a clip for holding the rail down on the rail foundation, whereby any tendency for the clip to move in at least one direction along said at least one side portion is countered.

* * * * *